US009845179B2

(12) United States Patent
Hoffman

(10) Patent No.: US 9,845,179 B2
(45) Date of Patent: Dec. 19, 2017

(54) GAS TIGHT RESEALABLE CAN END FOR BEVERAGE CONTAINERS

(71) Applicant: Jonathan Hoffman, Malibu, CA (US)

(72) Inventor: Jonathan Hoffman, Malibu, CA (US)

( * ) Notice: Subject to any disclaimer, the term of this patent is extended or adjusted under 35 U.S.C. 154(b) by 100 days.

(21) Appl. No.: 14/986,595

(22) Filed: Dec. 31, 2015

(65) Prior Publication Data

US 2017/0190478 A1 Jul. 6, 2017

(51) Int. Cl.
*B65D 41/04* (2006.01)

(52) U.S. Cl.
CPC ..... *B65D 41/0407* (2013.01)

(58) Field of Classification Search
CPC .... B65D 41/005; B65D 41/02; B65D 41/023; B65D 41/026; B65D 41/04; B65D 41/0407; B65D 2577/2041; B65D 43/0202
USPC ..... 220/260, 265, 266, 268, 269, 270, 272, 220/273, 359.2, 906, 201, 703, 704, 288; 53/492; 215/387, 250, 252, 253
See application file for complete search history.

(56) References Cited

U.S. PATENT DOCUMENTS

| | | | | |
|---|---|---|---|---|
| 4,580,692 | A * | 4/1986 | La Barge | B21D 51/383 220/240 |
| 8,844,747 | B2 * | 9/2014 | Petti | B65D 17/165 215/230 |
| 9,254,945 | B2 * | 2/2016 | McClung | B65D 47/106 222/541.9 |
| 2010/0025402 | A1 * | 2/2010 | Hoffman | B65D 17/166 220/270 |
| 2010/0133275 | A1 * | 6/2010 | Phillips | B65D 7/40 220/270 |
| 2010/0320207 | A1 * | 12/2010 | Sjogren | B65D 17/506 220/270 |

* cited by examiner

*Primary Examiner* — Kareen Thomas

(57) ABSTRACT

A resealable closure for a metal beverage container including a closure cap which engages with a dispensing mouth which provides an initial gas tight seal, tamper resistant and tamper evident means, good purchase and mechanical advantage to tighten and loosen as well as remove and apply the closure mechanism, a gas tight reseal capability, and a protected, hygienic dispensing mouth. The several embodiments of the invention employ designs, materials, and manufacturing methods which are inexpensive and consistent with current manufacturing practices. The functionality, size, cost, simplicity, reliability and robustness of the proposed designs are all advantageous.

2 Claims, 12 Drawing Sheets

GAS TIGHT RESEALABLE CAN END FOR BEVERAGE CONTAINERS

CROSS-REFERENCE TO RELATED APPLICATIONS

This application claims priority to U.S. Provisional Patent Application Ser. No. 62/124,763 filed Jan. 2, 2015 and titled GAS TIGHT RESEALABLE CAN END FOR BEVERAGE CONTAINERS, the contents of which is incorporated herein in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD

The field of this invention is closures for metal beverage containers, particularly resealable closures for metal beverage containers.

BACKGROUND OF THE INVENTION

In a conventional metal container for a carbonated beverage such as a soft drink or beer, the 'pop top' closure is integrated into the can end and incorporates a mechanical lever to facilitate the initial fracture, fracture propagation and ultimate displacement of the sealing panel formed integrally with the can end, to create a dispensing mouth through which container contents may be dispensed. This has proven to be a reliable, effective, and inexpensive means of providing an initial seal and dispensing means for carbonated drink products in metal containers. Once the dispensing means is deployed and the dispensing mouth is opened, however, there is no provision for reclosing or resealing the container as would be desirable to prevent spills particularly if the beverage container is in motion as would be the case if it is situated in a moving vehicle, to prevent contamination through the open dispensing mouth including entry of airborne dust or contaminants or insects, and to provide a gas tight sealing means to prevent the escape of the carbonating gases present in the liquid, an absence of which results in a 'flat' beverage which is generally thought to be unappealing and generally results in the beverage being discarded.

Further, the conventional 'pop top' actuating lever is considered by many, especially women with long and/or decorated fingernails, to be a less than optimal solution because it requires the user to slip their fingernail under the actuating lever which may cause damage to a polished or decorated fingernail, and also requires that the maximum force be applied during the initial displacement of the actuating lever which is when the dispensing mouth die-line fracture is initiated, by lifting up on the actuating lever with only the fingernail engaged under the edge of the actuating lever. This places a large amount of strain on the fingernail and the fingernail bed and is generally regarded as painful or unpleasant by many users, particularly if they must perform the task repeatedly as would be the case for a bartender or someone working in a retail or commercial environment where beverages in metal containers are regularly served. The actuating lever is so designed as to provide substantial mechanical advantage to facilitate the initial fracture of the dispensing mouth die-line, but there is inadequate mechanical engagement or 'purchase' with the user's finger at the point where maximum effort is required due to the close proximity of the actuating lever to the can end at the time the fracture is initiated.

For these reasons, it has long been thought desirable to incorporate a means of reclosing and preferably resealing metal containers for carbonated beverages as well as a means of improving purchase for initial opening to reduce or eliminate user discomfort.

There have been many attempts at a solution to the problems of resealing a metal beverage container once the initial seal has been broken, and to improving the purchase for initial opening of the dispensing means. The most rudimentary solution to the problem of reclosing a metal container is the use of a separate lid, such as a molded plastic lid which is so designed as to 'snap' onto the seam at the top of the metal container where the can end is joined to the can body. Such lids do provide a means of reclosing but do not provide a gas tight means of resealing.

Another solution to the problem of resealing a metal container for carbonated beverages is the development of fundamentally new closure means for metal containers. One example of such a new closure means is the Ball Resealable End or BRE which employs a complex, multi-layer plastic and rubber rotary seal and dispensing mechanism. The BRE has seen limited commercial use. Another example of a new closure means is the XO end which incorporates a sliding plastic closure means and a large diameter sealing wafer located inside the metal container.

The most rudimentary solution to the problem of inadequate purchase for the actuating lever on a conventional pop top can is the use of a specialized tool designed to slip under the actuating lever in lieu of the user's fingernail to initiate displacement of the lever, fracturing of the dispensing mouth die-line and displacement of the sealing panel.

One area of deficiency generally present in all of the proposed solutions to redesigned closures is high cost, particularly in comparison to the conventional pop top end.

Another deficiency generally present in all of the proposed solutions to redesigned closures is that some do not reliably provide a gas tight seal.

Yet another deficiency generally present in all of the proposed solutions to redesigned closures is that they present a disagreeable mouth feel to users.

A further deficiency generally present in all of the proposed solutions to redesigned closures is that they incorporate a large quantity of plastic inside of the can which cannot be removed unless the can is cut open, thereby creating a problem if one desires to recycle the can.

Yet another deficiency generally present in all of the proposed solutions to redesigned closures is that they will not run on conventional metal container filling and sealing equipment lines and require very costly special tooling in order to be used.

One area of deficiency generally present in all of the proposed solutions to the problem of improving purchase for opening existing pop top closures is the necessity of purchasing, and then remembering to keep proximal to any metal beverage containers which one may wish to open, the special tool described above.

A further area of deficiency present in conventional pop top can closures as well as all proposed solutions to the problems inherent therein is the vulnerability of the closure means to environmental contamination wherein the closure is unprotected from ambient conditions from the time it is initially filled, through shipping, warehousing, distribution, retail display, and ultimate purchase. This potentially exposes the entire metal container, particularly the dispensing mouth where the user will place their lips to consume the product, and in the case of the conventional pop top closure the sealing panel, which is displaced downwards to be immersed in the can contents, to unsanitary and potential dangerous or harmful contaminants.

While there are presently a number of proposed solutions to the problem of improving cleanliness and hygiene of closures, improving purchase on metal container closure means and providing gas tight resealability, none have been conceived or implemented to permit an easy to use, cost effective, recyclable, compatible with existing filling and sealing equipment solution which would be optimal for the application.

SUMMARY

Resealable can ends embodying the principles of this invention solve the problems of improved purchase for opening and resealing closures, and gas tight resealability for said closures for metal containers for carbonated beverages, as well as a hygienically protected dispensing mouth through which metal container contents are dispensed. The several embodiments of the invention employ designs, materials, and manufacturing methods which are inexpensive and consistent with current manufacturing practices. The functionality, size, cost, simplicity, reliability and robustness of the proposed designs are all advantageous.

Implementations following the principles of this invention allow the advantageous modality of hygienic, easy to open, gas tight resealable metal container closure means which would be optimal for the application.

This summary is intended to introduce the inventive concepts, principles and embodiments, not to define them

DETAILED DESCRIPTION

In conjunction with the included drawings, this detailed description is intended to impart an understanding of the teachings herein and not to define their metes and bounds.

Several particular implementations, illustrating aspects of the present teaching, are presented in detail below. Some of the many possible variations and versions are also described.

Figure 1A:
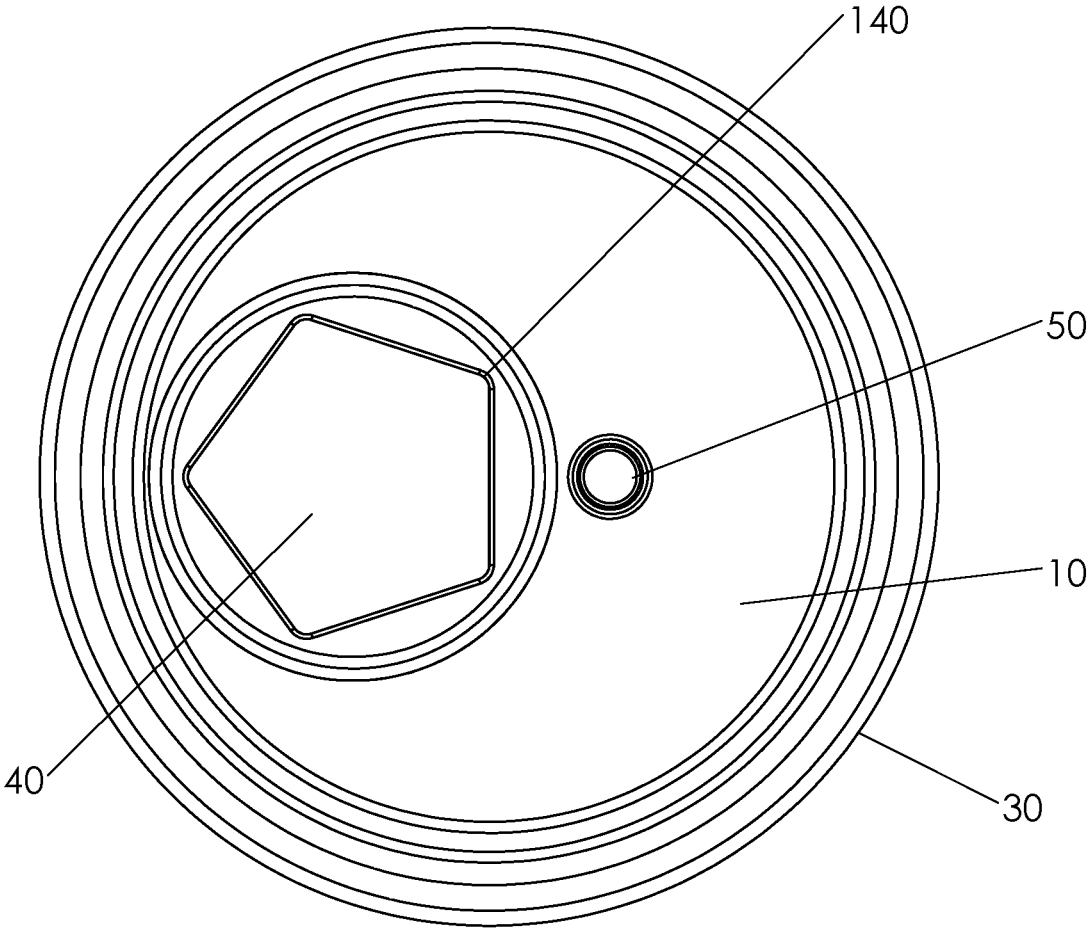
FIG. 1A shows a plan view of a can end for a metal beverage container embodying teachings of the present disclosure.

FIG. 1A shows a plan view of a can end 10 for a metal beverage container embodying teachings of the present disclosure wherein a distinctive dispensing mouth 40 may be plainly seen. One distinctive feature of dispensing mouth 40 is the polygonal shape which includes vertices 140, in contrast to the typically circular or rounded dispensing mouths found on conventional metal container can ends. Also distinctive is the asymmetrical placement of rivet 50 off center in can end 10 as opposed to the typical centered location on a conventional can end. Can end 10 does however contain a conventional seaming shoulder 30 so as to facilitate mechanical union with a conventional can shell in the filling/sealing process on industry standard equipment.

Figure 1B:
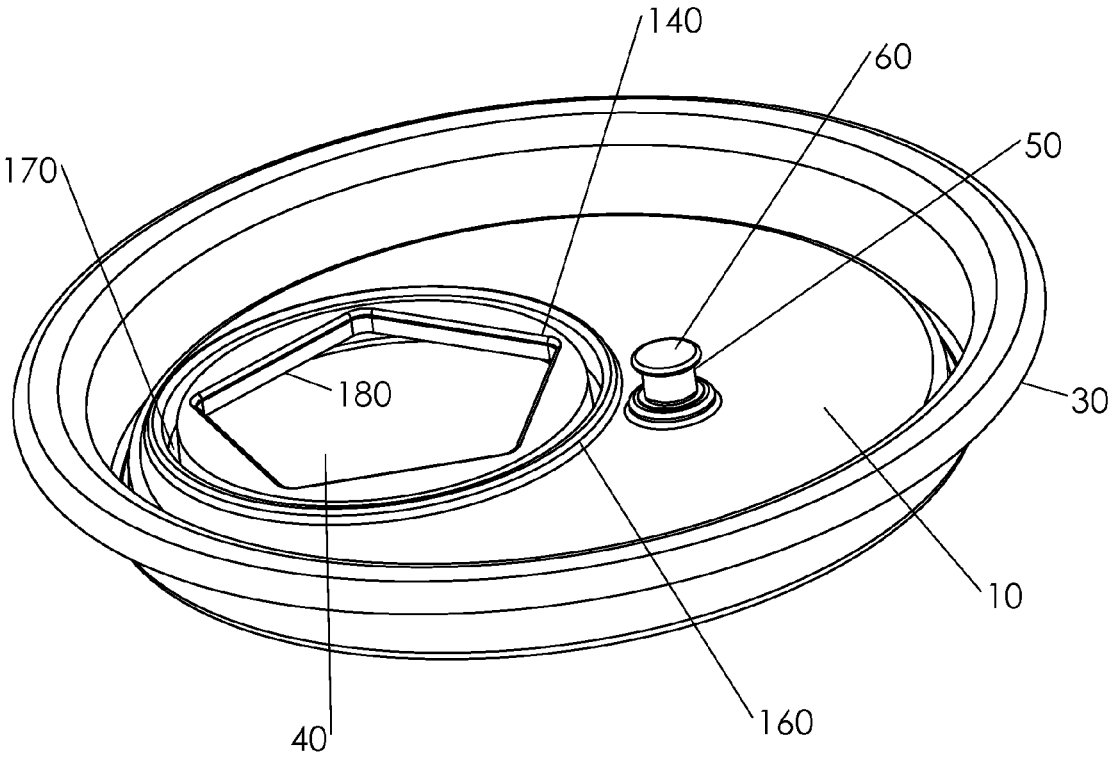
FIG. 1B shows a top side perspective view of a can end for a metal beverage container embodying teachings of the present disclosure.

FIG. 1B shows a top side perspective view of a can end 10 for a metal beverage container embodying teachings of the present disclosure in which several more distinctive features may be plainly seen. In this view, return wall 180 may be seen to protrude downwardly about the polygonal periphery of dispensing mouth 40. Also plainly visible is rigidifying well 170 which circumscribes dispensing mouth 40. In addition, sealing shoulder 160 may be seen to exist outwardly concentric to rigidifying well 170.

Figure 2:
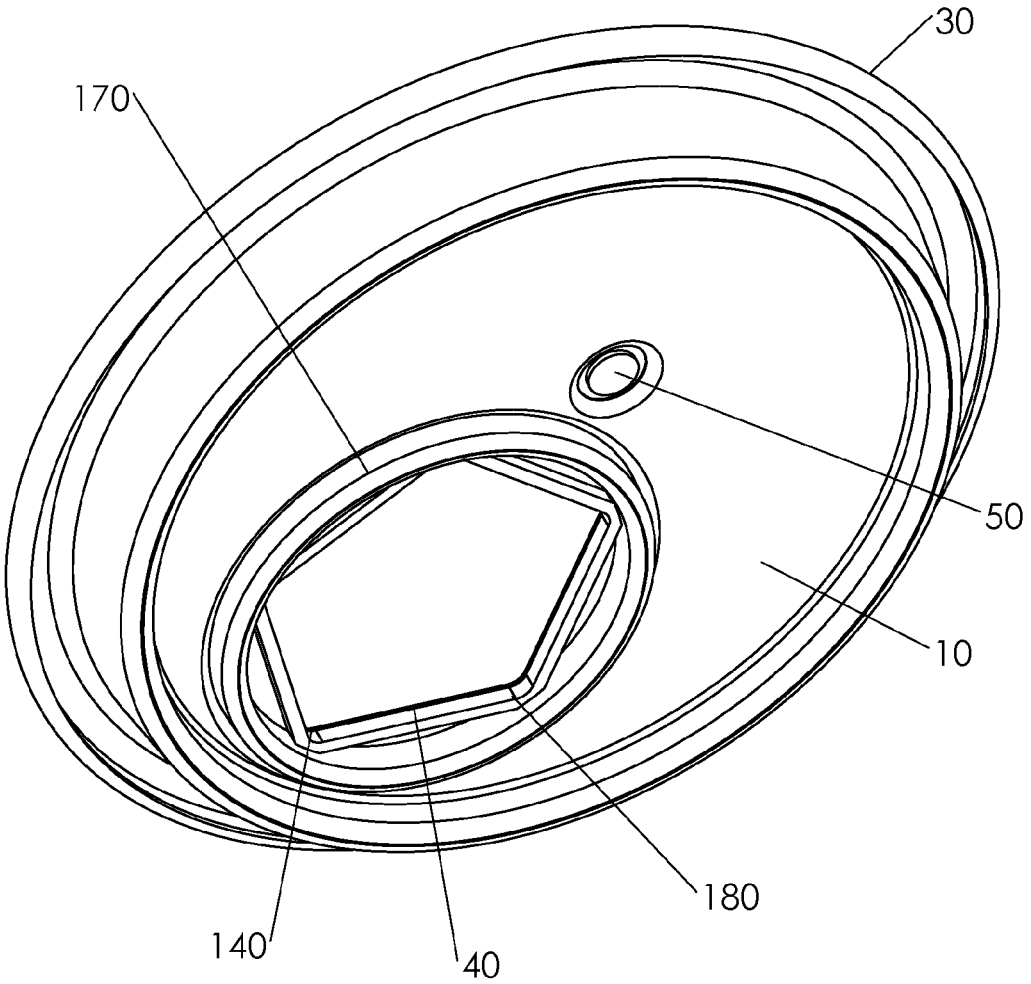
FIG. 2 shows an underside perspective view of a can end for a metal beverage container embodying teachings of the present disclosure.

FIG. 2 shows an underside perspective view of a can end 10 for a metal beverage container embodying teachings of the present disclosure which further illustrates the above noted features including rigidifying well 170, return wall 180, dispensing mouth vertices 140 and the distinctive polygonal shape of dispensing mouth 40.

Figure 3A:
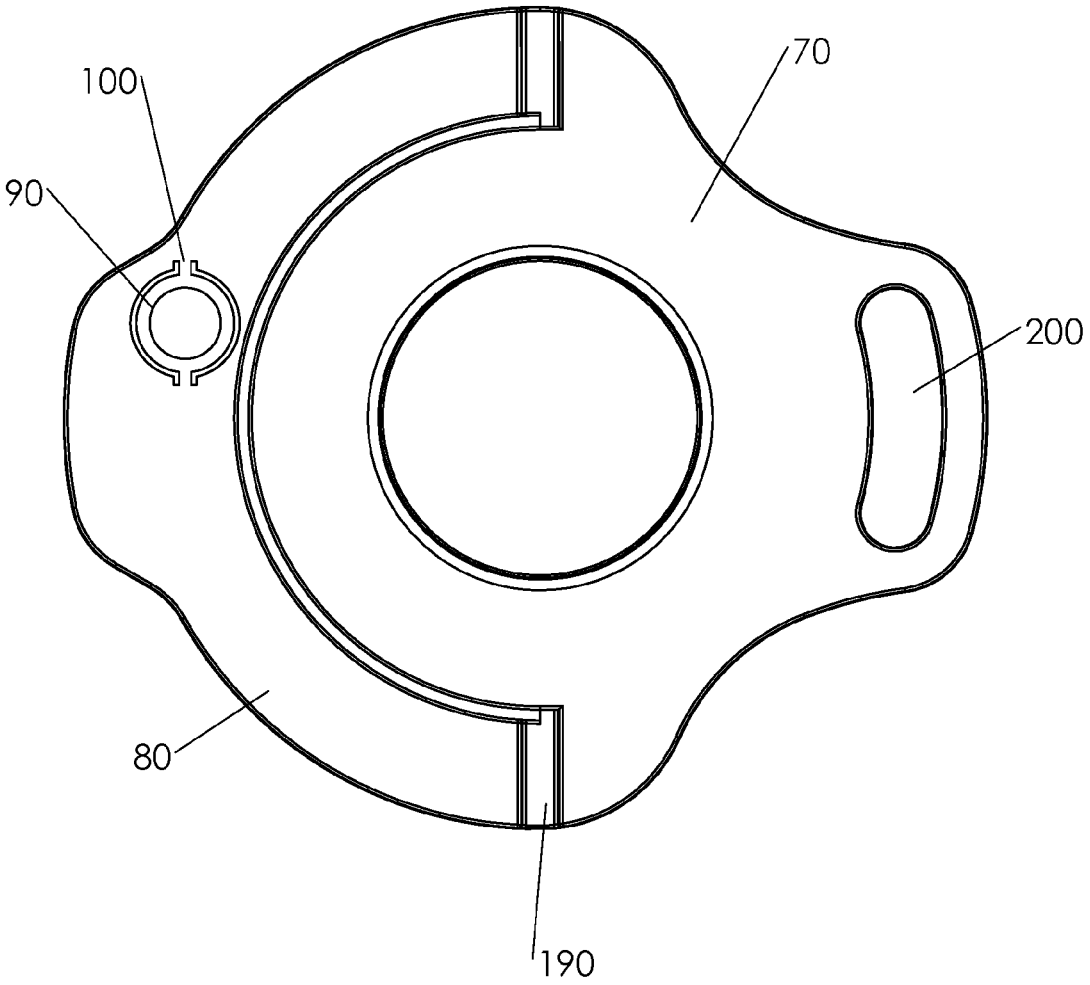
FIG. 3A shows a plan view of a closure cap for a metal beverage container embodying teachings of the present disclosure.

FIG. 3A shows a plan view of a closure cap 70 for a metal beverage container embodying teachings of the present disclosure in which several distinctive features may be plainly seen including radial slot 200, living hinges 190, tamper evident fracture ring 90, fracture tabs 100, and bail handle 80.

Figure 3B:
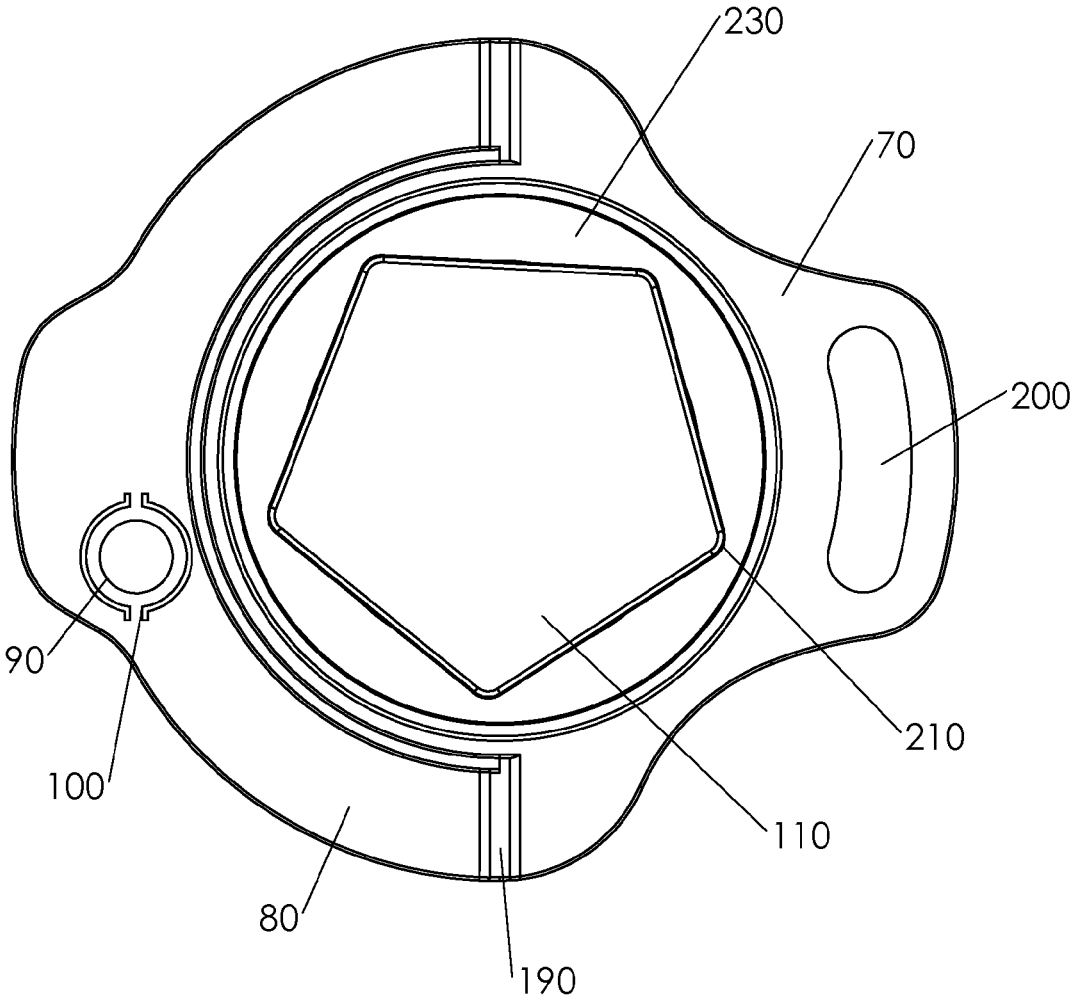
FIG. 3B shows an underside plan view of a closure cap for a metal beverage container embodying teachings of the present disclosure.

FIG. 3B shows an underside plan view of a closure cap 70 for a metal beverage container embodying teachings of the present disclosure which in addition to the above noted distinctive features also plainly shows locking wings 110 with locking wing vertices 210 and closure cap flange 230.

Figure 3C:
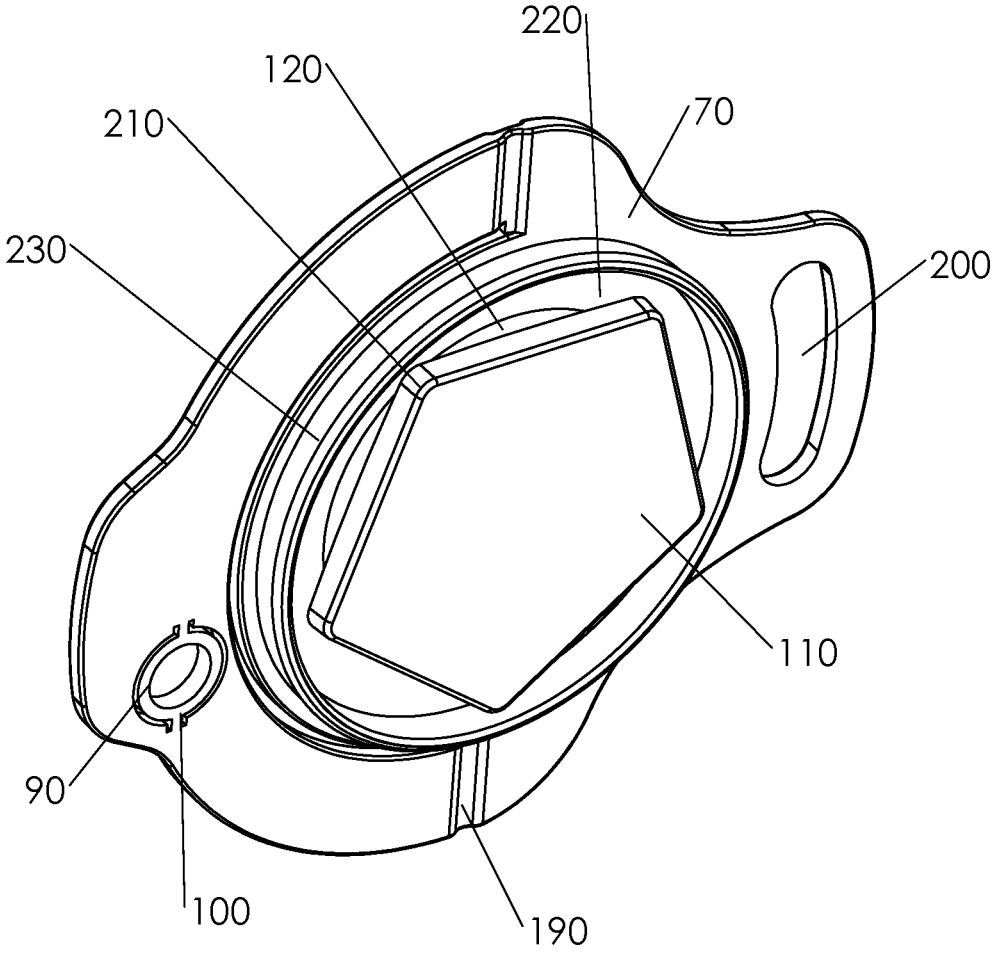
FIG. 3C shows an underside perspective view of a closure cap for a metal beverage container embodying teachings of the present disclosure.

FIG. 3C shows an underside perspective view of a closure cap 70 for a metal beverage container embodying teachings of the present disclosure wherein in addition to the above noted distinctive features, yet another crucial feature may be plainly seen. Standoff boss 120 protrudes downwardly from the underside of closure cap 70 and displaces locking wings downward such that an undercut 220 is formed between the lowermost surface of closure cap flange 230 and the uppermost surface of locking wings 110. By this means, closure cap 70 may be engaged with certain features of dispensing mouth 40 of can end 10 when inserted into dispensing mouth 40 and rotated, as will be more fully disclosed in a later section.

Figure 4A:
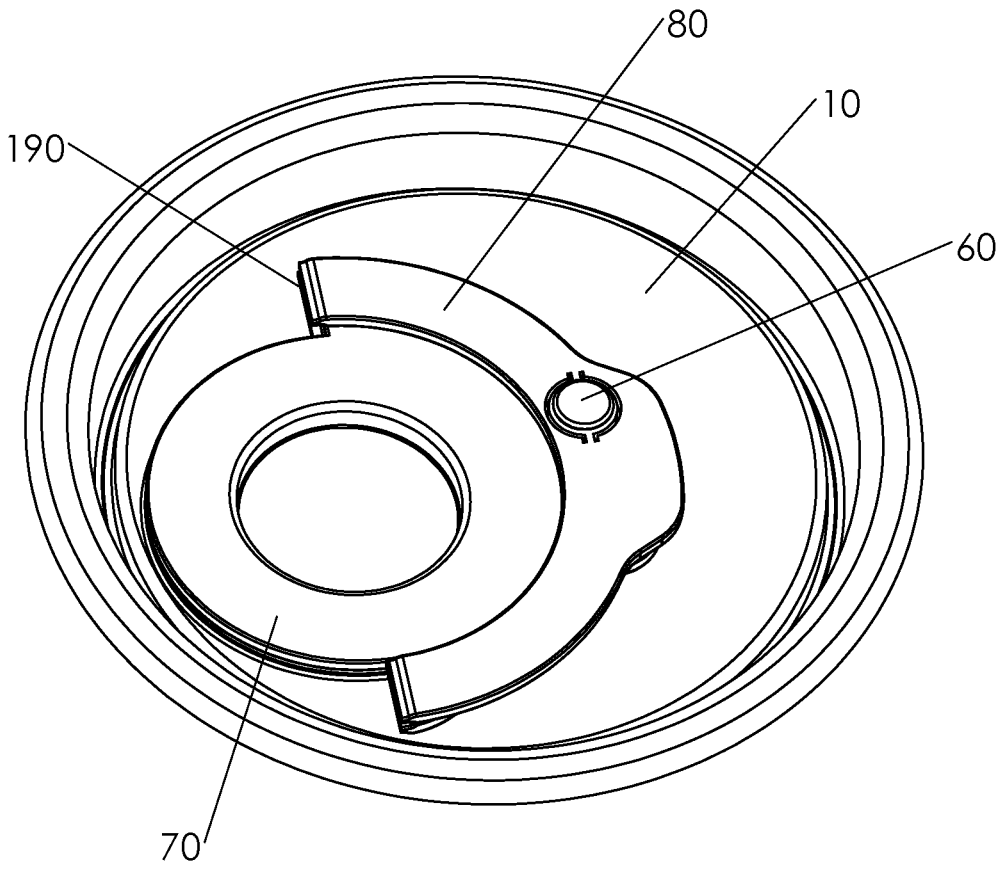
FIG. 4A shows a top side perspective view of a closure cap and can end assembly for a metal beverage container embodying teachings of the present disclosure.

FIG. 4A shows a top side perspective view of a closure cap 70 and can end 10 assembly for a metal beverage container embodying teachings of the present disclosure in which closure cap 70 is engaged with can end 10 in such a manner as to close and seal dispensing mouth 40 in a gas tight fashion. It should also be noted that bail handle 80 has been folded over at living hinges 190 into the stowed position where it is secured by the swage 60 of rivet 50 engaging with tamper evident tear tab 90.

Figure 4B:
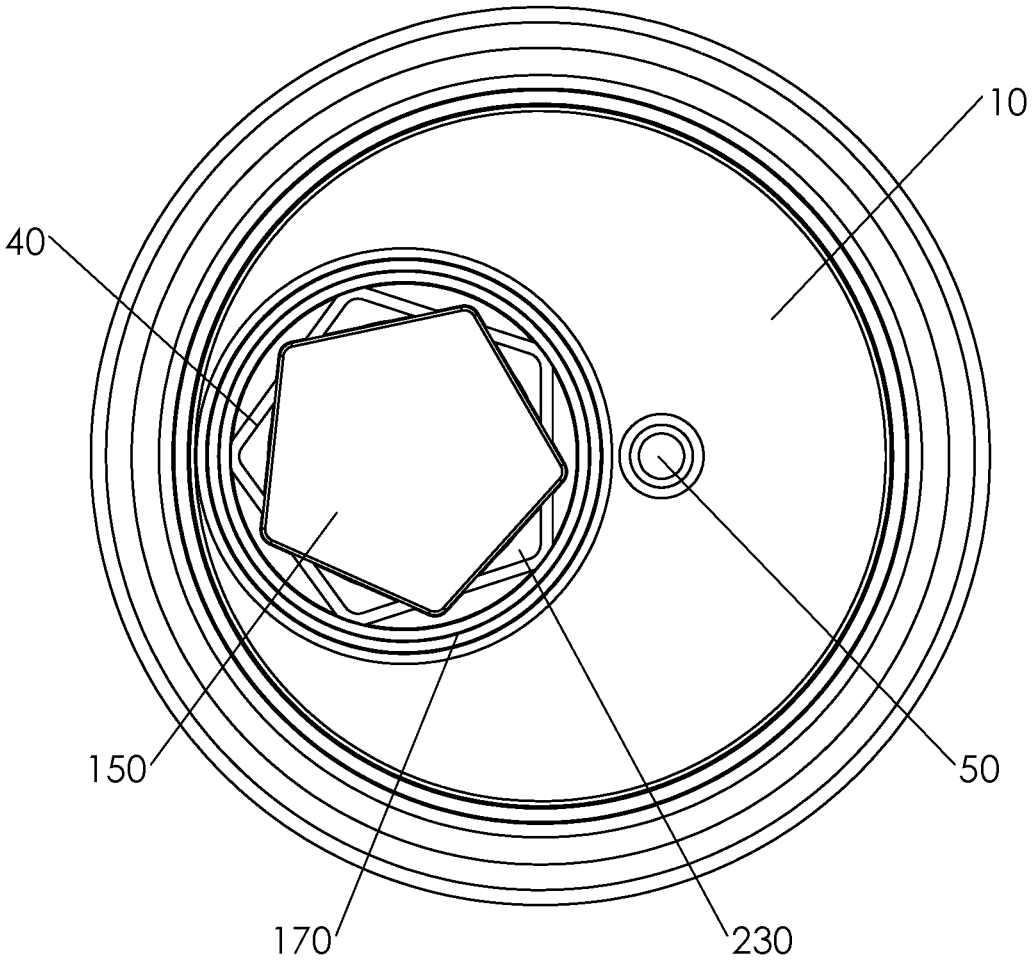
FIG. 4B shows an underside plan view of a closure cap and can end assembly for a metal beverage container embodying teachings of the present disclosure.

FIG. 4B shows an underside plan view of a closure cap 70 and can end 10 assembly for a metal beverage container embodying teachings of the present disclosure wherein in addition to the above noted distinctive features it may be plainly seen how sealing fin 150 has engaged with the underside of can end 10 in such a manner as to secure closure cap 70 within dispensing mouth 40.

Figure 5:
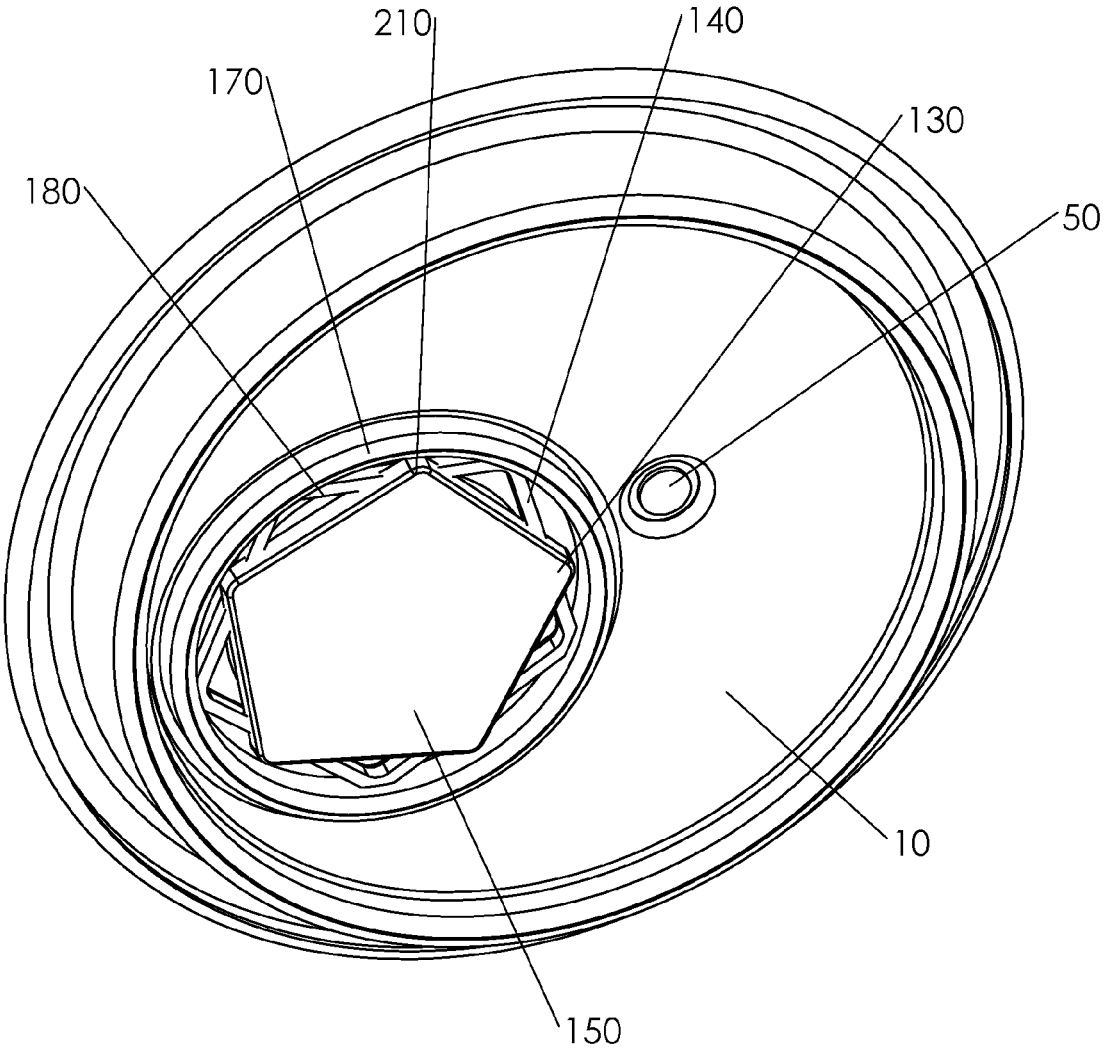
FIG. 5 shows a close-up detail underside plan view of a closure cap and can end assembly for a metal beverage container embodying teachings of the present disclosure.

FIG. 5 shows a close-up detail underside plan view of a closure cap 70 and can end 10 assembly for a metal beverage container embodying teachings of the present disclosure wherein the engagement means described above may be more clearly seen between top surface of sealing fins 150 which engage with the downwardly protruding face of return wall 180. In one embodiment the height of return wall 180 is variable such that it constitutes a ramp configuration wherein it protrudes minimally downward proximal to each dispensing mouth vertex 140 and progressively protrudes downward a greater amount as the distance from each dispensing mouth vertex 140 increases, as one moves in a counterclockwise direction when viewed from the underside of can end 10. By this means, the collective ramped lowermost edges of return walls 180 form an interrupted thread which when acting against locking wings 110 of closure cap 70 serve to draw closure cap 70 more deeply into dispensing mouth 40 as closure cap 70 is rotated in a clockwise direction as viewed from the topside of can end 10. In another embodiment, the height of return wall 180 remains constant and the thickness of sealing fins 150 vary such that undercut 220 becomes increasingly narrower as one moves in a clockwise direction when viewed from the underside of closure cap 70 such that, much like the variable height of return wall 180 above, an interrupted thread engagement is formed wherein progressive rotation of closure cap 70 within dispensing mouth 40 results in the advancement of a progressively diminishing undercut 220 against a constant height return wall 180, thereby ramping or augering closure cap 70 more and more firmly down into dispensing mouth 40 as limited by the pressure of closure cap flange 230 and sealing fin 150 against the topmost surface of sealing shoulder 160. By this means a gas tight initial seal is achieved and a gas tight reseal is achieved during successive reinstallations of closure cap 70.

Figure 6:
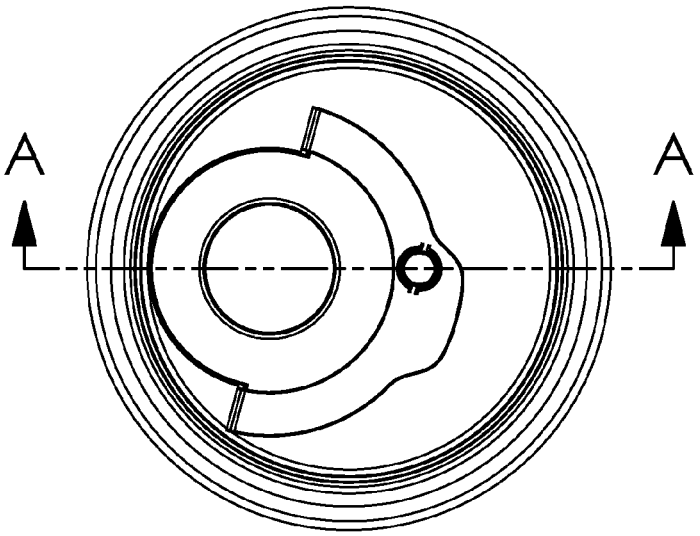
FIG. 6 shows a close-up detail cross section view of a closure cap and can end assembly for a metal beverage container embodying teachings of the present disclosure.
Figure 6:
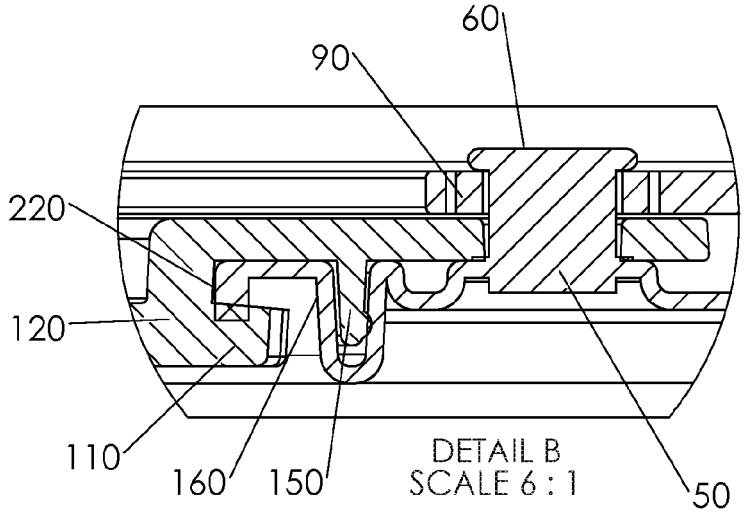
Figure 6:
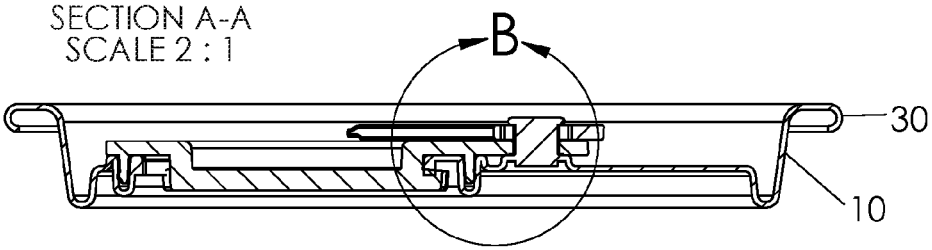

FIG. 6 shows a close-up detail cross section view of a closure cap and can end assembly for a metal beverage container embodying teachings of the present disclosure in which the locking and sealing means may be more plainly seen. In this detail view, the engagement of the uppermost face of locking wing 110 against the lowermost edge of return wall 180 is clearly visible and it may be understood how a progressive increase in downward pressure in this area such as would be achieved by the interrupted thread means described above causes closure cap flange 230 and sealing fin 150 to be drawn down against the top surface of sealing shoulder 160 with sufficient force as to constitute a gas tight seal.

Figure 7A:
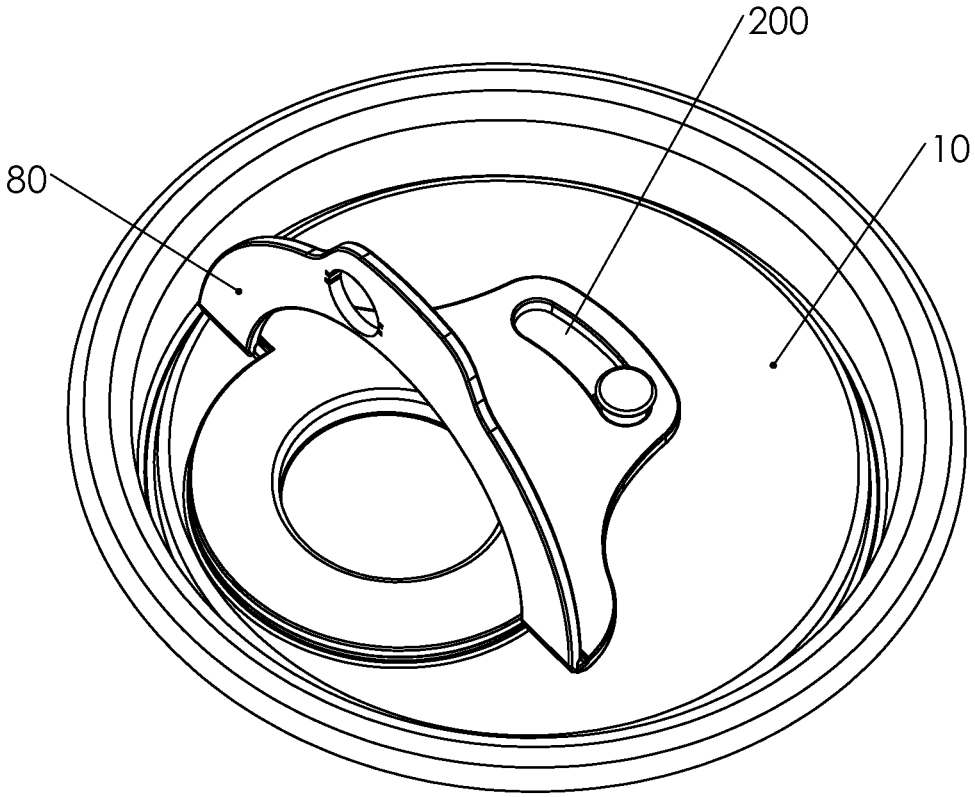
FIG. 7A shows a top side perspective view of a closure cap and can end assembly for a metal beverage container embodying teachings of the present disclosure in the unlocked position.

FIG. 7A shows a top side perspective view of a closure cap 70 and can end 10 assembly for a metal beverage container embodying teachings of the present disclosure in the unlocked position wherein closure cap 70 is resting in dispensing mouth 40 in the unlocked position ready to be removed in order to dispense can contents, or to be rotated into the locked position, either action facilitated by bail handle 80 which has been positioned in the upwards position which affords the user excellent purchase.

Figure 7B:
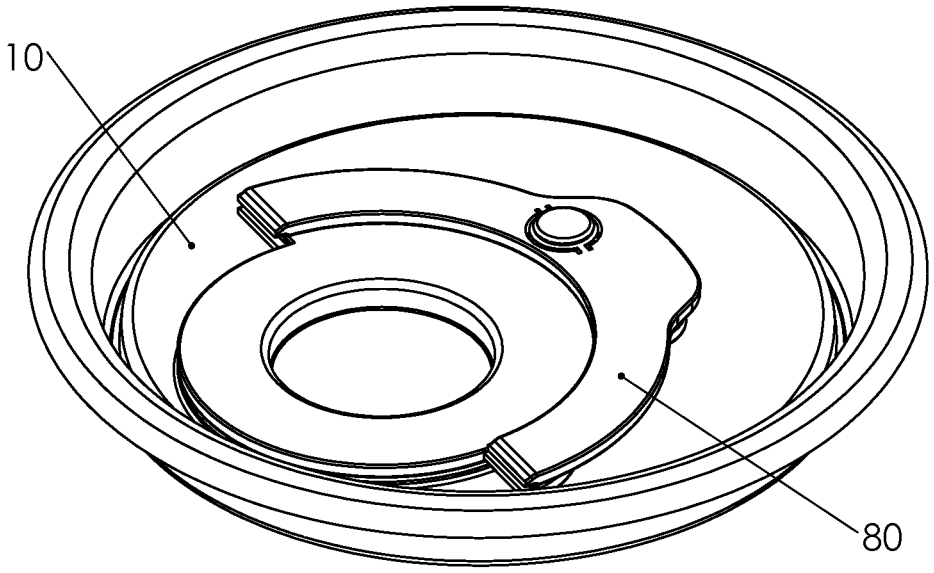
FIG. 7B shows a top side perspective view of a closure cap and can end assembly for a metal beverage container embodying teachings of the present disclosure in the locked position.

FIG. 7B shows a top side perspective view of a closure cap 70 and can end 10 assembly for a metal beverage container embodying teachings of the present disclosure in the locked position as would be typical of the initial, factory sealed condition, with tamper evident tear tab 90 intact and secured by the swage 60 of rivet 50.

Operation

The operation of the preferred embodiment of the invention is as follows:

FIG. 7B illustrates the assembled configuration of the preferred embodiment of the closure cap 70 and can end 10 constituting this invention wherein closure cap 70 has been rotatably engaged with can end 10 to create a gas tight seal, then bail handle 80 is folded over into the stowed position and secured in this position by means of a swage 60 on rivet 50 which protrudes through the center hole of tamper evident tear tab 90. In this assembled state, the can end assembly may be applied to a filled can body by conventional means by seaming to the can body utilizing standard progressive seaming dies. Once seamed to the filled can, the end acts as a conventional sealing means.

When a user wishes to dispense the liquid contents of the metal container, the closure cap 70 must be opened. This is accomplished by lifting bail handle 80 into the open or unlocked position as illustrated in FIG. 7A. In order to lift bail handle 80 the first time after initial filling and seaming of the can, the user must apply sufficient force to break tamper evident tear tab 90 out of bail handle 80 by ripping fracture tabs 100. Tamper evident tear tab 90 serves two functions: first, it is a visible deterrent to, and positive indication of tampering, or opening closure cap 70 subsequent to initial seal; and it serves as a positive mechanical lock to prevent accidental rotation and opening of closure cap 70. The user is able to grasp bail handle 80 between their thumb and forefinger, affording them excellent purchase and adequate mechanical advantage to rotate closure cap 70 counterclockwise to disengage the previously described threaded closure means which holds closure cap 70 tightly against can end 10 thereby releasing the gas tight seal. In the preferred embodiment of the present invention bail handle 80 is integrally molded with closure cap 70 and hingeably attached by means of living hinges. In alternate embodiments, bail handle 80 could be different shapes, geometries, or materials, or may be constructed of different materials including metal or plastics the same as or other than the materials used to construct closure cap 70 and may be hingeably attached to closure cap 70 by a mechanical pivot or some flexible material.

Referring now to FIG. 7A it may be seen that this rotating motion of closure cap 70 is facilitated by radial slot 200 which is so oriented and configured as to permit rotation of closure cap 70 about its center of rotation which is coincident with the geometric center of dispensing mouth 40, thereby permitting closure cap 70 to be rotatably engaged or disengaged using the interrupted thread means previously described, which remaining captively engaged by swage 60 of rivet 50. By this means, closure cap 70 remains fixably secured to can end 10 when sealed, unsealed, and even when displaced for beverage dispensing.

Referring now to FIG. 5, one may plainly see how closure cap 70 engages with can end 10 by the relative action of the polygonal shapes of dispensing mouth 40 and sealing fins 150. In one orientation, when sealing fins 150 are so aligned that sealing fin vertices 210 are substantially aligned with dispensing mouth vertices 140, because sealing fin 150 is the identical polygonal shape as the opening of dispensing mouth 40, but concentrically slightly smaller, sealing fins 150 may be understood to be able to drop down into dispensing mouth 40 when such an alignment exists. Similarly, sealing fins 150 may be withdrawn from dispensing mouth 40 when said alignment exists. When sealing fins 150 are rotated relative to dispensing mouth 40, however, such that sealing fin vertices 210 are no longer aligned with dispensing mouth vertices 140, it may be plainly seen how this creates an interference condition whereby closure cap 70 may no longer be removed.

Once closure cap 70 has been unscrewed to the unlocked or disengaged position, the user may grasp bail handle 80 and withdraw closure cap 70 vertically out of dispensing mouth 40 and rotate closure cap 70 around rivet 50 in order to position it clear of dispensing mouth 40 so as not to interfere with the poured dispensing of the liquid contents or to provide an unobstructed path for the user to place their mouth over dispensing mouth 40 to consume the liquid contents directly out of the can.

It should be noted that closure cap flange 230 advantageously covers the periphery of dispensing mouth 40 thereby protecting it from environmental contaminants during manufacture, transit, storage, or public display, and thereby dramatically improving the sanitary and hygiene conditions of the dispensing mouth 40. A further benefit of this design is the absence of a sealing panel which would be displaced downwards into the liquid contents of the can during initial opening of dispensing mouth 40, thereby further reducing the possibility of contamination of the liquid contents.

After partial dispensing or consumption of the liquid contents, if the user wishes to reclose and reseal the can, the procedure is the reverse of the above outlined steps. First the user grasps bail handle 80 and lifts and rotates closure cap 70 into position over dispensing mouth 40. Once positioned concentrically over dispensing mouth 40 and once aligned as described earlier such that dispensing mouth vertices 140 are substantially aligned with sealing wing vertices 210, the user applies slight downward pressure to seat closure cap 70 fully within dispensing mouth 40, then rotates closure cap 70 clockwise to progressively engage locking wings 110 with return wall 180, thereby augering closure cap 70 into dispensing mouth 40 and creating a gas tight seal between sealing fin 150 and sealing shoulder 160.

Once can contents have been fully dispensed or consumed, the metal container may be recycled without fear of contaminating the recycle process by tearing the closure cap 70 off of can end 10 and separately recycling this plastic component.

Variations

There are many possible variations of the implementations described above consistent with the teaching of the present disclosure. Variations include different sizes, shapes, colors, textures, and materials for the various components of the assembly.

In the preferred embodiment, the closure cap is made of injection molded plastic, but could be made of other materials including rubber or stamped or cast metal. Similarly, the bail handle can be made in many different shapes, sizes, geometries, configurations and materials. In the preferred embodiment the can end is made out of stamped aluminum in the conventional manner and the rivet is stamped from the same material, and therefor hollow. In alternative embodiments, the can end and/or the can itself could be made of other materials including plastic, even transparent or translucent plastic materials, or metals other than aluminum such as steel or tin, or even paperboard or laminated composite materials. Similarly in alternate embodiments the rivet could be solid, or a separate piece bonded or welded or by some other means permanently attached to the can end, or the rivet could be entirely replaced by another mechanism which performs the same function of providing a fixed pivot point about which the radial slot on the closure cap may rotate and pivot.

In broad embodiment, the present invention is a resealable closure for a metal beverage container including a closure cap which engages with a dispensing mouth which provides an initial gas tight seal, tamper resistant and tamper evident means, good purchase and mechanical advantage to tighten and loosen as well as remove and reapply the closure mechanism, a gas tight reseal capability, and a protected, hygienic dispensing mouth. The several embodiments of the invention employ designs, materials, and manufacturing methods which are inexpensive and consistent with current manufacturing practices. The functionality, size, cost, simplicity, reliability and robustness of the proposed designs are all advantageous.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed:

1. A re-sealable can end for closing a vessel comprising:

(a) a generally planer top panel having an inner surface for facing into the vessel and an opposite outer surface, said top panel having an opening through which vessel contents may be poured or consumed;

(b) a closure cap which removably seals said panel opening said closure cap having a radial slot, living hinges, a tamper evident fracture ring, fracture tabs, and a bail handle;

(c) said closure cap having a downwardly extending seal lock body which extends into an interior of the vessel and below the inner surface of the can end;

(d) said closure cap so configured that, if unconstrained postionally, the seal lock would be a loose fit in the opening in at least one orientation;

further, said closure cap so attached to said top panel as to allow freedom of relative movement comprising:

i. a first freedom of movement permitting a manual rotational translation of an actuator from a initial sealed state to an unsealed state in which the closure cap and an opening region are in alignment in a plan view with the seal lock extending through the opening;

ii. a second freedom of movement permitting, from the unsealed state, a rotational movement pivoting about a point generally central to the seal lock and providing a degree of angular rotation to allow the seal lock to be manually pivoted in-place;

further, a portion of the seal lock that is below the inner surface when in a ready-to-seal state has a shape comprising an interrupted thread, a twisting of the thread pulls the actuator sealingly down against an outer surface of the top panel that surrounds the opening thereby sealing the opening.

2. The re-closable can end of claim 1 wherein the interrupted thread is comprised of two or more opposed wings forming a helix shape.

* * * * *